United States Patent [19]

Figgie, III et al.

[11] Patent Number: 4,490,855

[45] Date of Patent: Jan. 1, 1985

[54] KNEE PAD

[75] Inventors: Harry E. Figgie, III, Pepper Pike; Matthew P. Figgie, Willoughby, both of Ohio

[73] Assignee: Figgie International Inc., Willoughby, Ohio

[21] Appl. No.: 503,037

[22] Filed: Jun. 10, 1983

[51] Int. Cl.[3] ..... A41D 13/06

[52] U.S. Cl. ..... 2/24; 2/62; 2/DIG. 6

[58] Field of Search ..... 2/22, 23, 24, 62, 16; 128/165, 80 C

[56] References Cited

U.S. PATENT DOCUMENTS

| | | | |
|---|---|---|---|
| 1,601,659 | 9/1926 | Van Harlingen . | |
| 1,835,295 | 8/1931 | Glahe . | |
| 1,862,303 | 6/1932 | Glahe . | |
| 2,031,622 | 2/1924 | Walker | 2/24 |
| 3,945,046 | 3/1976 | Stromgren | 2/22 |
| 4,024,584 | 5/1977 | Smith | 2/24 |
| 4,344,189 | 8/1982 | Futere et al. | 2/16 |

*Primary Examiner*—Henry S. Jaudon
*Assistant Examiner*—Tracy Graveline
*Attorney, Agent, or Firm*—Senniger, Powers, Leavitt and Roedel

[57] ABSTRACT

A knee pad comprising an upper pad which may be secured on the leg at a point above the knee and a lower pad which may be secured on the leg at a point below the knee. A cover holds portions of the two pads in overlapping relation at the front of the knee for protecting it. The pads are freely movable with respect to one another inside the cover when the knee is flexed.

17 Claims, 4 Drawing Figures

KNEE PAD

BACKGROUND OF THE INVENTION

This invention relates generally to athletic equipment and more particularly to a knee pad.

Protection of the knee presents particular problems in contact sports such as football. As the leg is flexed, conventional cover pads tend to ride off the knee, leaving it unprotected and thus vulnerable to contusions, abrasions and other types of injury. If steps are taken to maintain the pad on the knee, as by taping the pad on the knee, the flexibility of the leg, and thus the maneuverability of the athlete, is impaired.

Reference may be made to U.S. Pat. Nos. 1,601,659, 1,835,295, 1,862,303, 2,031,622 and 4,024,584 which show various prior art devices for protecting the knee.

SUMMARY OF THE INVENTION

Among the several objects of the invention may be noted the provision of an improved knee pad which remains properly positioned on the knee even when the leg is repeatedly flexed; the provision of such a knee pad which is comfortable to wear and which does not restrict either the blood circulation or the maneuverability of the person wearing it; the provision of such a knee pad which is simply and reliably held in place on the knee without the use of tape, garters or the like; and the provision of such a knee pad which protects not only the front of the knee but also the surrounding areas of the leg.

Generally, a knee pad of this invention comprises an upper pad having upper and lower portions, a lower pad having upper and lower portions, cover means holding the lower portion of the upper pad and the upper portion of the lower pad in overlapping relation, means for securing the upper pad on the leg at a point above the knee, and means for securing the lower pad on the leg at a point below the knee. The overlapping portions of the pads are adapted to cover the knee to protect it and are freely movable with respect to one another inside the cover when the knee is flexed. The cover is adapted to hold the pads in relatively close conformance with the knee when the knee is flexed.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
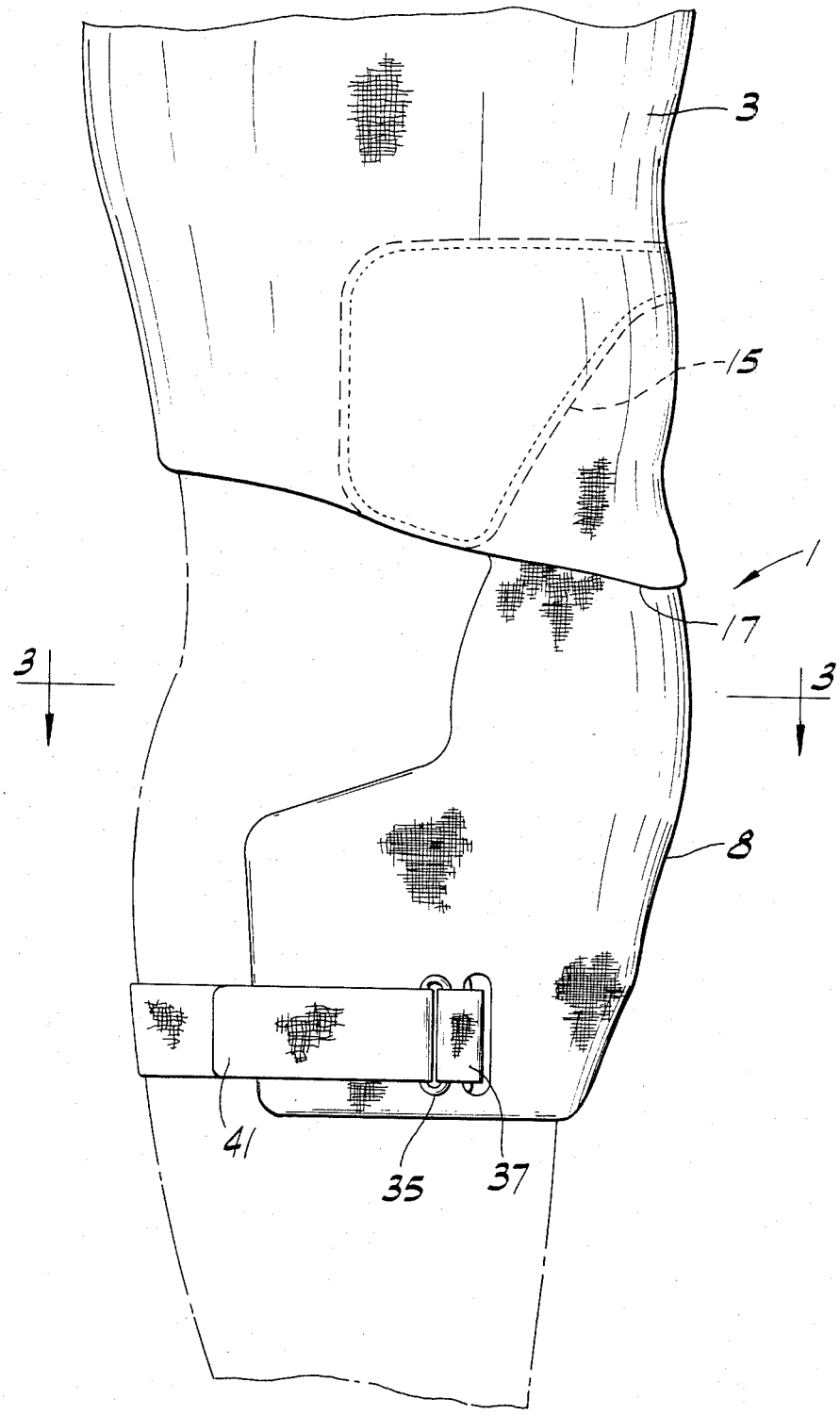
FIG. 1 is a side elevation showing a knee pad of this invention worn on a leg in conjunction with a pair of athletic pants.

Referring now to the drawings, a knee pad of this invention, designated in its entirety by the reference numeral 1, is shown on the leg of an athlete wearing a pair of conventional football pants 3. The knee pad comprises upper and lower pads generally designated 5 and 7, respectively, and cover means 8 which encloses the pads and holds them in overlapping relation at the front of the knee for protecting it. As will appear, the knee pad is also designed for protecting other injury-prone parts of the leg immediately adjacent the knee, such as the patella tendon above the knee, and the collateral ligaments below the knee at opposite sides of the leg.

Figure 2:
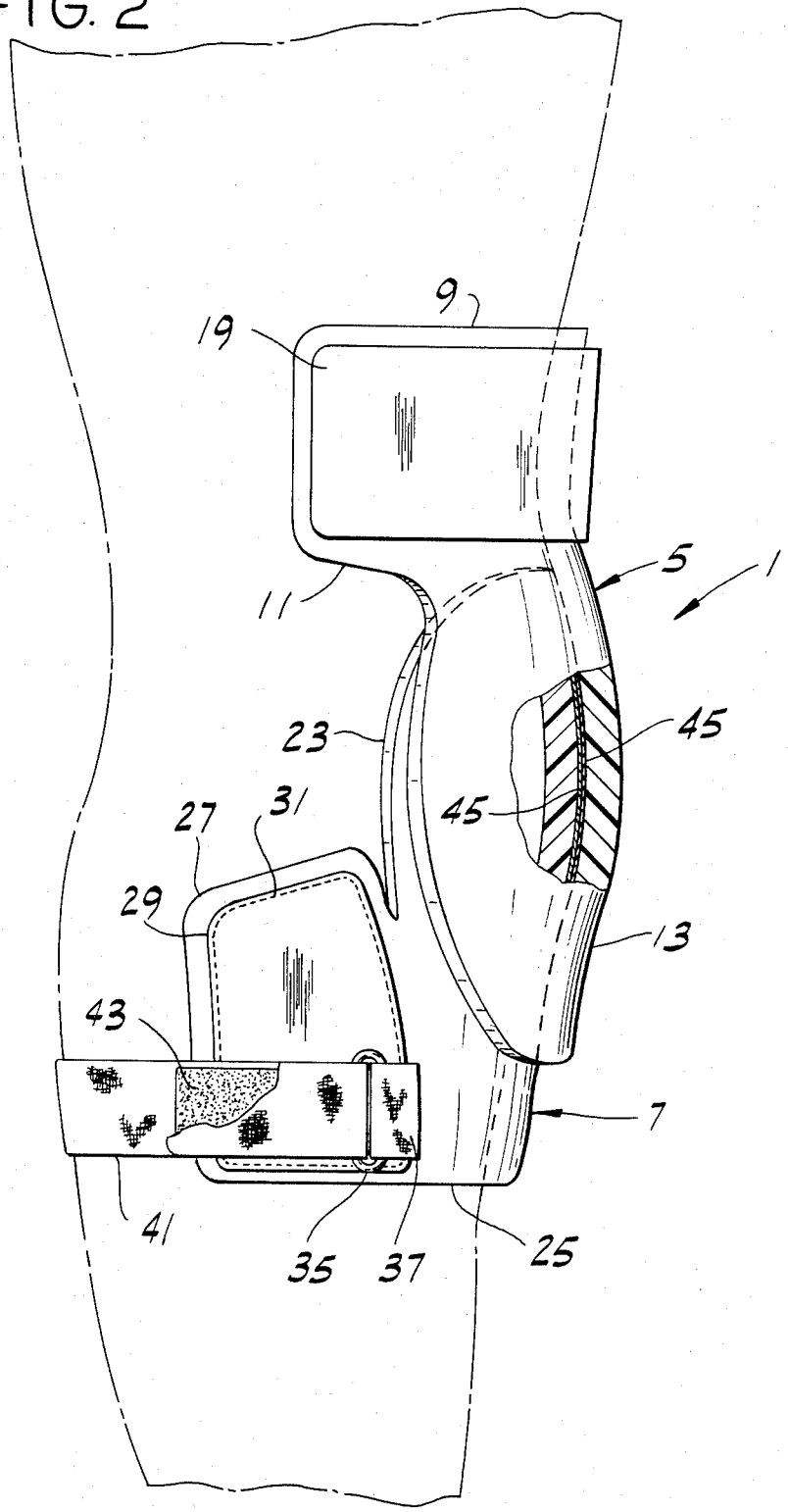
FIG. 2 is a view similar to FIG. 1 with the athletic pants and portions of the knee pad removed to illustrate additional details.
Figure 3:
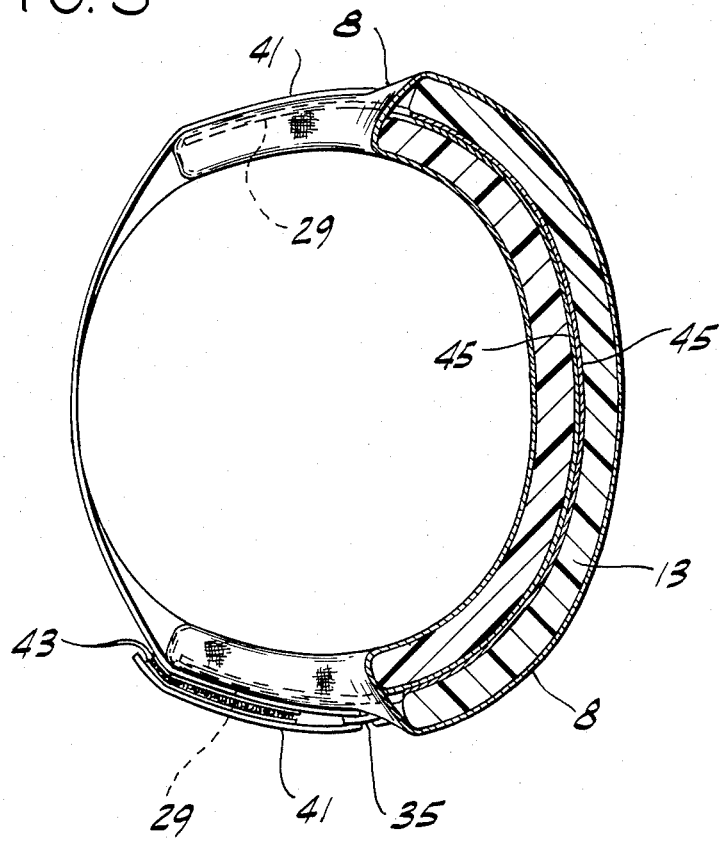
FIG. 3 is a section along line 3—3 of FIG. 1.

The upper pad 5, which may be fabricated from any suitable closed-cell rubber-like foam material, has an enlarged upper portion 9 formed in part by a pair of laterally extending ears 11 (only one ear is shown in FIG. 2; the other ear on the opposite side of the leg is identical), and a lower portion 13 for covering the knee. The ears 11 are receivable in two pockets 15 sewn in the bottom of a leg of the pants 3 on the inside of the pants, the ears thus constituting means for removably securing the upper pad to the pants. Other means of securement may also be suitable. The lower elastic edge 17 of the pants leg encircles the leg at a point immediately below the ears 11 and binds the upper pad to the leg for holding the pad in place on the leg of the wearer. With the ears 11 of the upper pad received in the pants pockets 15, the lower portion 13 of the pad is disposed forward of the knee to protect it (see FIG. 2).

A strip 19 of protective material (e.g., polyethylene) preferably extends across the outer surface of the upper portion 9 of the upper pad 5 to provide additional protection to the patella tendon at the front of the leg immediately above the knee. This protective strip 19 may be sewn or otherwise suitably secured to the upper pad.

The lower pad 7 is preferably of the same material as the upper pad 5. It has an upper portion 23 for protecting the knee and enlarged lower portion 25 formed in part by a pair of laterally extending rectangular extensions or flaps 27 on opposite sides of the pad at its lower end. The flaps 27 extend on opposite sides of the leg below the knee for protecting the collateral ligaments below the knee at opposite sides of the leg. A substantially rigid impact-resistant plate 29 of suitable material (e.g., polyethylene) may be secured by stitching 31, for example, to each of the flaps for providing additional protection (if needed) for the collateral ligaments against blows received from the sides of the leg.

A metal loop 35 on a short piece of strapping 37 stitched to one of the flaps 27, and a strap 41 secured at one of its ends to the other flap 27, constitute means for strapping the lower pad 7 to the leg at a point below the knee. The strap 41 is intended to be passed behind and around the leg and through the loop, pulled tight, and then secured in position. Securement may be accomplished by the use of suitable fastening means, such as "Velcro"-type fastening means, in which the outer (free) end of the strap 41 has patches 43 of cooperable hook and loop fastener elements thereon which may be interengaged by folding the strap back on itself after it has been passed through the loop 35, thereby releasably fastening the strap in position for strapping the lower pad 7 in place on the leg. When the lower pad is secured in position (FIG. 2), the strap 41 holds the flaps 27 in proper position flat against the sides of the leg.

As shown in the drawings, the lower portion 13 of the upper pad 5 and the upper portion 23 of the lower pad 7 overlap one another at the knee, with the upper pad being shown as being on the outside of (in front of) the lower pad although this can be reversed. To avoid any interference with the normal movement of the leg, the pads are entirely free of interconnection and are thus free to slide with respect to one another inside cover means 8 as the athlete flexes his leg, as during running, jumping, etc. To minimize the amount of sliding friction between the two pads, the overlapping surfaces of the pads in face-to-face contact are faced with a relatively low-friction materiall 45, such as nylon cloth, which enables the pads to slide on one another without undue drag.

Figure 4:
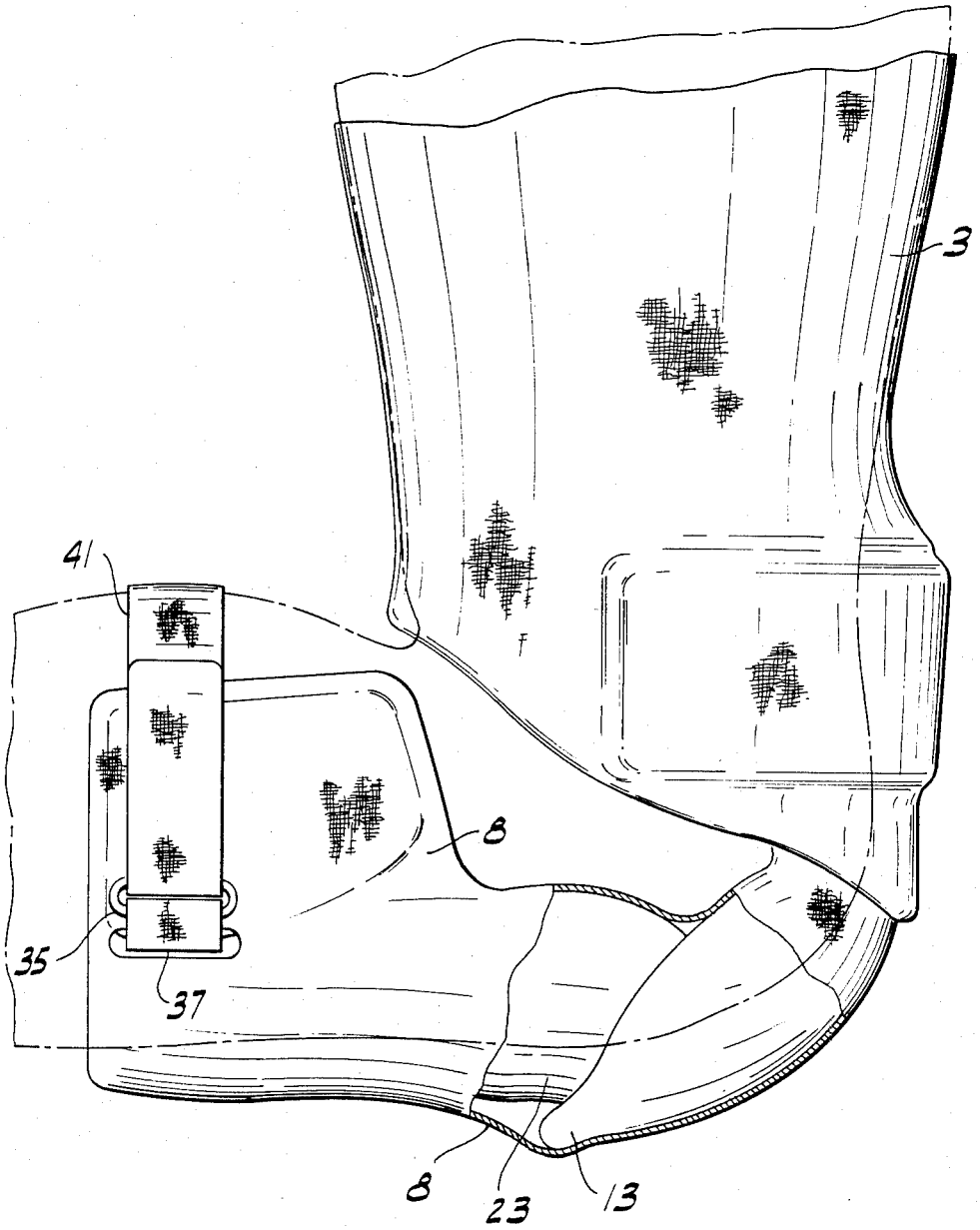
FIG. 4 is a view similar to FIG. 1 showing the knee pad with the leg flexed, portions of the knee pad being broken away to illustrate details.

Cover means 8 comprises a sheath of flexible material (e.g., cloth) enclosing the upper and lower pads 5, 7. This cover functions to hold the lower portion 13 of the upper pad and the upper portion 23 of the lower pad in overlapping relation and in relatively close conformance to the knee when the knee is flexed, as shown in FIG. 4. It will be observed in this regard that when the knee is fully flexed, the ends of the pads still overlap to protect the knee. The overlapping portion of the pads (i.e., the lower portion 13 of the upper pad and the upper portion 23 of the lower pad) may be concave to more closely conform to the shape of the knee.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A knee pad comprising:

a flexible upper pad having upper and lower portions;

a flexible lower pad having upper and lower portions;

cover means holding the lower portion of the upper pad and the upper portion of the lower pad in overlapping relation;

means for securing the upper pad on the leg at a point above the knee; and means for securing the lower pad on the leg at a point below the knee, the overlaping portions of the pads being adapted to cover the knee to protect it and being freely movable with respect to one another inside said cover means when the knee is flexed, said cover means being adapted to hold the pads in relatively close conformance with the knee, said pads being adapted to flex in said cover means when the knee is flexed, and said pads being sized and shaped for remaining in overlapping relation even when the knee is fully flexed thereby to provide maximum protection for the knee.

2. A knee pad as set forth in claim 1 wherein said means for securing the upper pad on the leg comprises a pair of ears extending laterally from the upper portion of the pad, said ears being interengageable with a garment at a point above the knee for removably securing the upper pad on the leg.

3. A knee pad as set forth in claim 1 further comprising a strip of protective material extending across the outer surface of the upper portion of the upper pad for providing additional protection for the patella tendon at the front of the leg above the knee.

4. A knee pad as set forth in claim 1 wherein the lower portion of the lower pad has a pair of laterally extending flaps adapted to extend on opposite sides of the leg below the knee for protecting the collateral ligaments of the leg.

5. A knee pad as set forth in claim 4 further comprising a substantially rigid impact-resistant plate on the outside of each flap for providing addtional protection for the collateral ligaments.

6. A knee pad as set forth in claim 1 wherein the overlapping surfaces of the upper and lower pads are covered with a relatively low-friction material for enabling the pads more freely to slide with respect to one another when the knee is flexed.

7. A knee pad as set forth in claim 6 wherein said low-friction material is nylon cloth.

8. A knee pad as set forth in claim 1 wherein said means for securing the lower pad on the leg comprises a loop attached at one side of the lower pad and a strap attached at the oppposite side of the lower pad, said strap being adapted to be passed behind the leg, through the loop, and then secured in position.

9. A knee pad as set forth in claim 8 whererein the outer free end of the strap has releasably interengageable fastening elements thereon, said elements being interengageable when the strap is passed through the loop and folded back on itself for releasably fastening the strap around the leg.

10. A knee pad as set forth in claim 8 wherein the lower portion of the lower pad has a pair of laterally extending flaps adapted to extend on opposite sides of the leg below the knee for protecting the collateral ligaments of the leg.

11. A knee pad as set forth in claim 10 wherein said loop is attached to one of the flaps and the strap is attached to the other flap, said strap, when secured around the leg, being adapted to hold the flaps against opposite sides of the leg.

12. A knee pad as set forth in claim 10 wherein said means for removably securing the upper pad on the leg comprises a pair of ears extending laterally from the upper portion of the pad, said ears being interengageable with a garment at a point above the knee for removably securing the upper pad on the leg.

13. A knee pad as set forth in claim 12 further comprising a strip of protective material extending across the outer surface of the upper portion of the upper pad for providing additional protection for the patella tendon at the front of the leg above the knee.

14. A knee pad as set forth in claim 1 wherein said cover means comprises a flexible sheath enclosing the upper and lower pads.

15. A knee pad as set forth in claim 14 wherein the overlapping portions of the pads inside said sheath are free of interconnection for enabling them freely to move with respect to one another when the knee is flexed.

16. A knee pad as set forth in claim 15 further comprising a strip of protective material extending across the outer surface of the upper portion of the upper pad for providing additional protection for the patella tendon at the front of the leg above the knee.

17. A knee pad as set forth in claim 16 wherein the lower portion of the lower pad has a pair of laterally extending flaps adapted to extend on opposite sides of the leg below the knee for protecting the collateral ligaments of the leg.

* * * * *